US007162996B2

(12) United States Patent
Yang

(10) Patent No.: US 7,162,996 B2
(45) Date of Patent: Jan. 16, 2007

(54) ENGINE BRAKING METHODS AND APPARATUS

(75) Inventor: Zhou Yang, South Windsor, CT (US)

(73) Assignee: Jacobs Vehicle Systems, Inc., Bloomfield, CT (US)

( * ) Notice: Subject to any disclaimer, the term of this patent is extended or adjusted under 35 U.S.C. 154(b) by 166 days.

(21) Appl. No.: 10/739,098

(22) Filed: Dec. 19, 2003

(65) Prior Publication Data

US 2004/0187842 A1 Sep. 30, 2004

Related U.S. Application Data

(60) Provisional application No. 60/435,295, filed on Dec. 23, 2002.

(51) Int. Cl.
*F02D 13/04* (2006.01)
*F01L 1/34* (2006.01)

(52) U.S. Cl. ..... 123/321; 123/90.16; 123/568.14

(58) Field of Classification Search ..... 123/321, 123/568.14, 322, 347, 348, 90.16
See application file for complete search history.

(56) References Cited

U.S. PATENT DOCUMENTS 3,220,392 A 11/1965 Cummine
4,107,776 A * 8/1978 Beale ..... 701/99
4,572,114 A 2/1986 Sickler
5,647,318 A * 7/1997 Feucht et al. ..... 123/322
5,794,735 A * 8/1998 Sigl ..... 180/170
6,000,374 A * 12/1999 Cosma et al. ..... 123/321
6,371,065 B1 * 4/2002 Shiraishi et al. ..... 123/90.15
6,394,067 B1 * 5/2002 Usko et al. ..... 123/321
6,510,824 B1 1/2003 Vorih et al.
6,594,996 B1 7/2003 Yang
6,732,685 B1 * 5/2004 Leman ..... 123/90.12
6,752,225 B1 * 6/2004 Kojima ..... 180/65.3
2001/0002379 A1 * 5/2001 Schechter ..... 477/115
2001/0023671 A1 * 9/2001 Vorih ..... 123/90.12
2001/0037793 A1 * 11/2001 Robichaux et al. .... 123/339.19
2002/0056435 A1 * 5/2002 Yang et al. ..... 123/321
2002/0115531 A1 * 8/2002 Degroot et al. ..... 477/92
2003/0221663 A1 12/2003 Vanderpool et al.

* cited by examiner

*Primary Examiner*—John T. Kwon
(74) *Attorney, Agent, or Firm*—David R. Yohannan, Esq.; Kelley Drye & Warren LLP

(57) ABSTRACT

Methods and apparatus for providing bleeder-type and compression-release engine braking in an internal combustion engine are disclosed. For bleeder-type engine braking, the exhaust valve is maintained at a small and relatively constant lift throughout all or much of the engine cycle. The engine braking may be combined with exhaust gas recirculation, variable exhaust brake, and/or operation of a variable geometry turbocharger.

47 Claims, 12 Drawing Sheets

ENGINE BRAKING METHODS AND APPARATUS

FIELD OF THE INVENTION

The present application relates to, and is entitled to the earlier filing date and priority of U.S. provisional patent application No. 60/435,295 which was filed Dec. 23, 2002 and entitled "Engine Braking Methods and Apparatus."

Field of the Invention

The present invention relates to methods and apparatus for braking an internal combustion engine. More specifically, the present invention relates to engine braking by controlling the flow of exhaust gas through the engine.

BACKGROUND OF THE INVENTION

Engine braking systems have been known for many years. Such systems may be particularly useful in heavy vehicles, such as trucks and buses, because these vehicles have heightened braking needs and commonly use diesel engines. Engine braking systems are needed in diesel engine vehicles because of the inherent cylinder aspiration that results from the valve timings (main intake and main exhaust events) that are required for positive power operation.

Past engine braking systems have added compression-release openings of the exhaust valve near the end of the compression stroke to the positive power valve events (i.e., main exhaust events) to affect a braking force on the drive train. During compression-release braking, fuel injection is stopped and the exhaust valves are also opened near the end of the compression stroke to convert a power producing internal combustion engine into a power absorbing air compressor.

Each compression stroke may be used to slow a vehicle equipped with a compression-release brake. During the compression stroke, the piston travels upward and compresses the gases trapped in the cylinder. The compressed gases oppose the upward motion of the piston. During engine braking operation, as the piston approaches top dead center (TDC), the exhaust valves are opened to release the compressed gases to the exhaust manifold, preventing the energy stored in the compressed gases from being returned to the engine on the subsequent expansion down-stroke. In doing so, the engine develops retarding power to help slow the vehicle down. An example of a known compression-release engine brake is provided by the disclosure of the Cummins, U.S. Pat. No. 3,220,392 (November 1965), which is incorporated herein by reference.

Bleeder type engine brakes provide an alternative to compression-release type engines brakes. Known bleeder brakes have added a small amount of lift (x)to the entire exhaust valve opening profile, as shown by the change from exhaust valve lift profile A to profile B in FIG. 1. Thus, known bleeder brakes hold the exhaust valve(s) slightly open during the intake, compression and expansion strokes, and produce an exaggerated main exhaust lift during the exhaust stroke. This is referred to as full-cycle bleeder braking and is illustrated by profile B in FIG. 1. Partial-cycle bleeder braking is also possible. Partial-cycle bleeder braking results when the exhaust valve(s) are maintained slightly open during much, but not all, of the intake, compression and expansion strokes. Typically, a partial-cycle bleeder brake differs from a full-cycle bleeder brake by closing the exhaust valve(s) during most of the intake stroke. An example of a known bleeder type engine brake is provided by the disclosure of Yang, U.S. Pat. No. 6,594,996 (Jul. 22, 2003), which is incorporated herein by reference.

Usually, the initial opening of the braking valve(s) in a bleeder braking operation is far in advance of the compression TDC (i.e., early valve actuation) and then lift is held constant for a period of time. As such, a bleeder type engine brake requires much lower force to actuate the valve(s) due to early valve actuation, and generates less noise due to continuous bleeding instead of the rapid blow-down of a compression-release type brake. Moreover, bleeder brakes often require fewer components and can be manufactured at lower cost. Thus, an engine bleeder brake can have significant advantages.

Despite these advantages, however, bleeder type engine brakes have not been widely used because they typically produce less braking power than the compression-release type brakes. One factor that detracts from the braking power of bleeder brakes is their inability to carry out bleeder braking throughout the entire engine cycle. Previous bleeder brakes have not held the exhaust valve open throughout the engine cycle at a relatively constant lift. Instead, the normal main exhaust valve event (during the exhaust stroke) has been superimposed over the bleeder brake opening, thereby resulting in an exhaust valve lift profile shown as profile B in FIG. 1.

The exhaust valve lift profile B in FIG. 1 not only includes a main exhaust event, but even worse, an exaggerated main exhaust event. The main exhaust event included in profile B has the lift of a normal main exhaust event (profile A), plus the bleeder brake lift (x). This exaggerated lift can affect bleeder braking power negatively. Furthermore, this exaggerated lift can cause the exhaust valve to extend so far into the engine cylinder that valve to piston contact is possible. The risk of valve to piston contact may require that pockets be drilled into the piston to accommodate the exhaust valve. Such pockets can have negative effects on positive power and emissions.

Thus, the present Applicants have determined that the inclusion of the main exhaust event in a bleeder braking cycle may reduce the effectiveness of the bleeder brake and/or reduce the desirability of an engine equipped to provide bleeder braking. Applicants have also determined that the elimination, reduction, or delay of a main exhaust event may impact engine braking positively. Both bleeder braking and compression-release braking may be carried out on a two-cycle basis (i.e., for each up-down stroke of the piston) when the main exhaust event is eliminated, reduced or delayed. Accordingly, there is a need for a bleeder braking system and method that may not include a full main exhaust valve event during bleeder brake or compression-release brake operation.

The braking power of an engine (bleeder and compression-release) brake may be a function of the exhaust back pressure against which the cylinders act. This exhaust back pressure can be regulated in various ways. Three primary ways are through the use of a variable geometry turbocharger (VGT), exhaust gas recirculation (EGR), and exhaust pressure regulation (EPR). Each of these ways of increasing and regulating exhaust pressure may be used singly or in combination to improve engine braking.

VGT's may enable intake and/or exhaust manifold pressures to be increased as compared with those produced using conventional fixed geometry turbochargers. These increased pressures may correspond to improved engine brake performance, especially at low and moderate engine speeds. Although it is recognized that the operation of an engine brake (particularly a bleeder brake) may be preferred when used in conjunction with a VGT, it is recognized that effective engine braking may still be carried out with a fixed geometry turbocharger (FGT).

EGR involves the recirculation of gas from the exhaust manifold side of an engine back to the intake side or to the cylinder of the engine. EGR may be carried out in an engine during positive power and/or engine braking for a number of reasons. For the purposes of this discussion, Applicant's reference to "EGR" is intended to be expansive and includes, but is not limited to, "brake gas recirculation" (BGR) which may be carried out to improve engine braking.

The recirculation of exhaust gas can be carried out in one of two ways. In a first way, referred to as internal EGR, exhaust gas is forced back from the exhaust manifold into the cylinder and potentially further back past the intake valve and into the intake manifold. In the second way, referred to as external EGR, the exhaust manifold gas may be routed through a passage provided between the exhaust manifold and the intake manifold and/or any engine components provided between the two manifolds. Certain performance and emissions advantages may be realized during positive power by using EGR. The affect of EGR on exhaust manifold pressure also may be used during engine braking to control and/or improve braking power because braking power may be a function of exhaust back pressure.

EPR can be achieved by devices designed to restrict the flow of exhaust gas out of the engine. One prime example of such a device is an exhaust brake. An exhaust brake can be created by placing a gate valve, or some other type of restrictive device, in the exhaust system between the exhaust manifold and the end of the tail pipe. When the gate valve is fully or partially closed it increases the exhaust back pressure experienced by the engine. Because the exhaust brake can be selectively actuated, it can provide EPR that is used to modulate engine braking. If the exhaust brake is able to provide selective levels of actuation, it can provide even more sophisticated EPR, and thus improved engine braking control.

The use of VGT's, EGR, and/or EPR may permit the levels of pressure and temperature in the exhaust manifold and engine cylinders to be controlled and maintained such that optimal degrees of engine braking are attained at any engine speed. While it is understood that the inclusion of VGT, EGR, and/or EPR may provide improved engine braking, their inclusion is not required to experience improved braking through the reduction or elimination of the main exhaust valve event from the engine braking cycle. It is therefore an advantage of some, but not necessarily all, embodiments of the present invention to provide methods and systems for achieving engine braking that include the reduction, delay, and/or elimination of the main exhaust valve event during engine braking. Additional advantages of various embodiments of the invention are set forth, in part, in the description that follows and, in part, will be apparent to one of ordinary skill in the art from the description and/or from the practice of the invention.

SUMMARY OF THE INVENTION

Responsive to the foregoing challenges, Applicants have developed an innovative method of actuating intake and exhaust engine valves in an internal combustion engine cylinder to produce an engine braking effect, said method comprising the steps of: opening at least one intake valve during an intake stroke of the engine cylinder; and providing a substantially constant lift to at least one exhaust valve during a plurality of successive intake, compression, expansion, and exhaust strokes of the engine cylinder.

Applicants have further developed an innovative method of actuating at least one exhaust valve in an internal combustion engine cylinder to produce an engine braking effect, said method comprising the step of: maintaining the at least one exhaust valve open with a substantially constant lift during intake, compression, expansion, and exhaust strokes of the engine cylinder.

Applicants have still further developed an innovative method of actuating engine valves including at least one exhaust valve in an internal combustion engine cylinder to produce an engine braking effect, said method comprising the steps of: maintaining the at least one exhaust valve open with a substantially constant lift during compression, expansion, and exhaust strokes of the engine cylinder; and maintaining the at least one exhaust valve closed during at least a portion of an intake stroke of the engine cylinder.

Applicants have still further developed an innovative method of actuating intake and exhaust valves in an internal combustion engine cylinder to produce an engine braking effect, said method comprising the steps of: actuating at least one intake valve during an intake stroke of the engine cylinder using a variable valve actuation system; and actuating at least one exhaust valve during at least portions of compression, expansion, and exhaust stokes of the engine cylinder using an engine braking device.

Applicants have also developed an innovative apparatus for actuating at least one exhaust valve in an internal combustion engine cylinder to produce a main exhaust event during positive power operation and an engine braking effect during engine braking operation, said apparatus comprising: means for opening the at least one exhaust valve for the main exhaust event during an engine exhaust stroke; and means for maintaining the at least one exhaust valve open with a substantially constant lift during engine intake, compression, expansion, and exhaust strokes.

Applicants have further developed an innovative apparatus for actuating at least one exhaust valve in an internal combustion engine cylinder to produce a main exhaust event during positive power operation and an engine braking effect during engine braking operation, said apparatus comprising: means for opening the at least one exhaust valve for the main exhaust event during an engine exhaust stroke; and means for maintaining the at least one exhaust valve open with a substantially constant lift during substantially all of engine compression, expansion, and exhaust strokes.

Applicants have still further developed an innovative method of actuating intake and exhaust valves in an internal combustion engine cylinder to produce an engine braking effect, said method comprising the steps of: determining an engine braking power goal; implementing an engine braking method based at least in part on the engine braking power goal, said engine braking method being selected from the group consisting of one or more of: full bleeder braking, partial bleeder braking, compression-release braking, two-cycle braking, four-cycle braking, and exhaust back pressure regulation; actuating one or more engine valves based at least in part on the engine braking method; and determining whether the engine braking goal is being met.

It is to be understood that both the foregoing general description and the following detailed description are exemplary and explanatory only, and are not restrictive of the invention as claimed.

BRIEF DESCRIPTION OF THE DRAWINGS

In order to assist the understanding of this invention, reference will now be made to the appended drawings, in which like reference characters refer to like elements.

DETAILED DESCRIPTION OF EMBODIMENTS OF THE INVENTION

Figure 1:
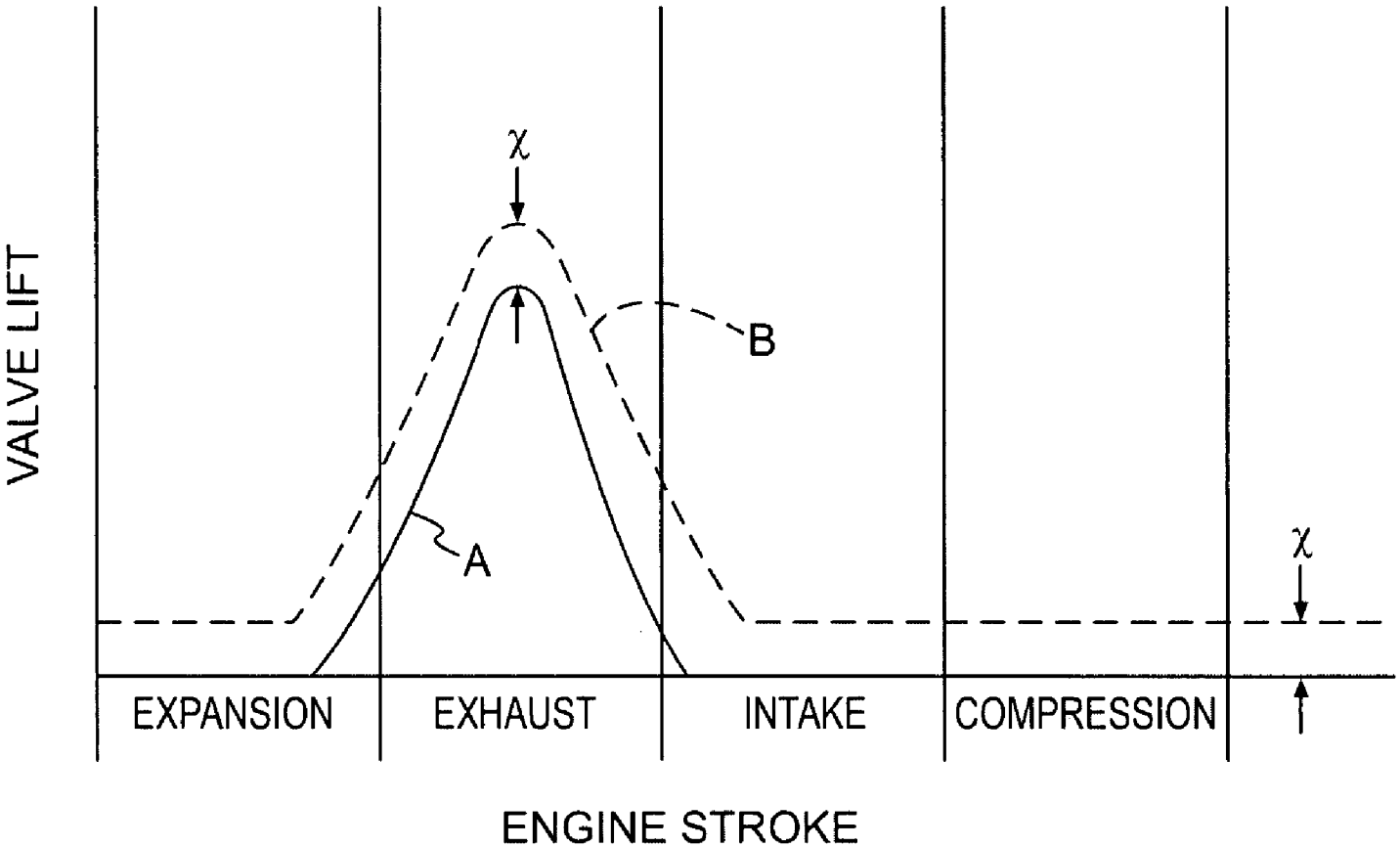
FIG. 1 is a graph of exhaust valve lift for a full engine cycle provided by known bleeder brakes.
Figure 2:
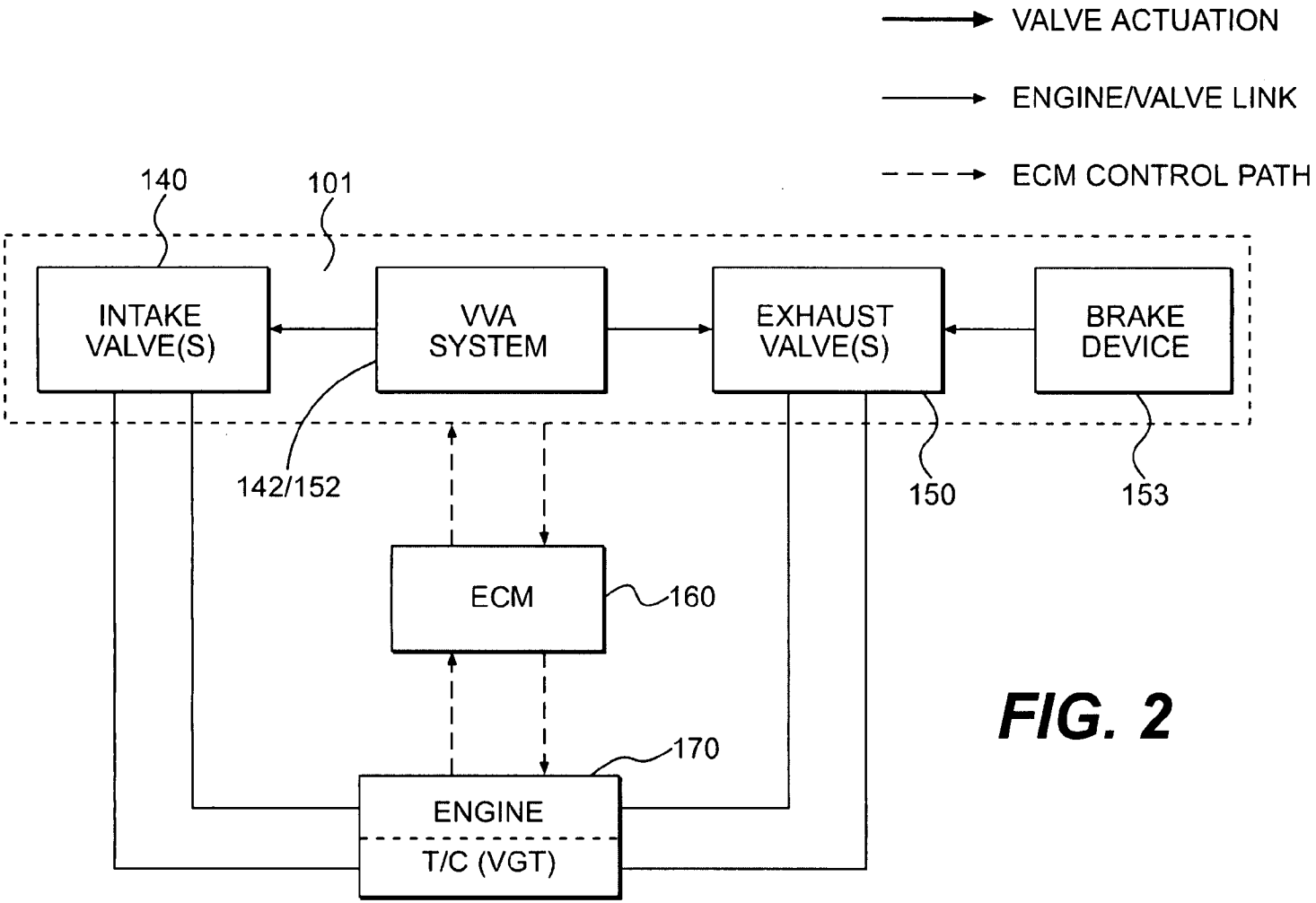
FIG. 2 is a flow diagram of the mechanical and control connectivity between engine components in a first system embodiment of the present invention.

Reference will now be made in detail to a first system embodiment of the present invention, an example of which is illustrated in FIG. 2. The valve actuation system 101 may include a VVA system 152/142 operatively connected to one or more intake valves 140 and one or more exhaust valves 150. The VVA system may include separate components 142 and 152 dedicated to operation of the intake valves and exhaust valves, respectively, or it may be a combined system. An engine braking device 153 also may be operatively connected to the exhaust valves 150. In some embodiments of the present invention, particularly the compression-release embodiments, a discrete engine braking device 153 may be eliminated by incorporating the engine braking functionality into the VVA system 152/142.

The valve actuation system 101, and particularly the VVA system 152/142 and the engine braking device 153 may be operatively connected to an ECM 160. The ECM 160 may provide control signals to, and receive feedback signals from, the valve actuation system 101. The ECM 160 also may be operatively connected to an engine turbocharger 170 (which is preferably a VGT). The ECM 160 may receive pressure, temperature, speed, load, and other information from engine sensors to determine control instructions for the VVA system 152/142, the braking device 153, and the turbocharger 170. The turbocharger 170 may be operatively connected to the intake valves 140 and the exhaust valve 150.

The valve actuation system 101 shown in FIG. 2 is adapted to provide variable valve actuation, including but not limited to cylinder cut-out, for the intake valves 140 and the exhaust valves 150. The exhaust valves 150 also may be actuated by the engine braking device 153. The exhaust valves 150 may be independently actuated by the VVA system 152/142 and the engine braking device 153. The ability to actuate the exhaust valves 150 using these two independent systems enables the exhaust valves to provide dedicated positive power events during positive power operation and dedicated engine braking events during engine braking. This independence may be particularly well suited for bleeder-type engine braking.

Figure 3:
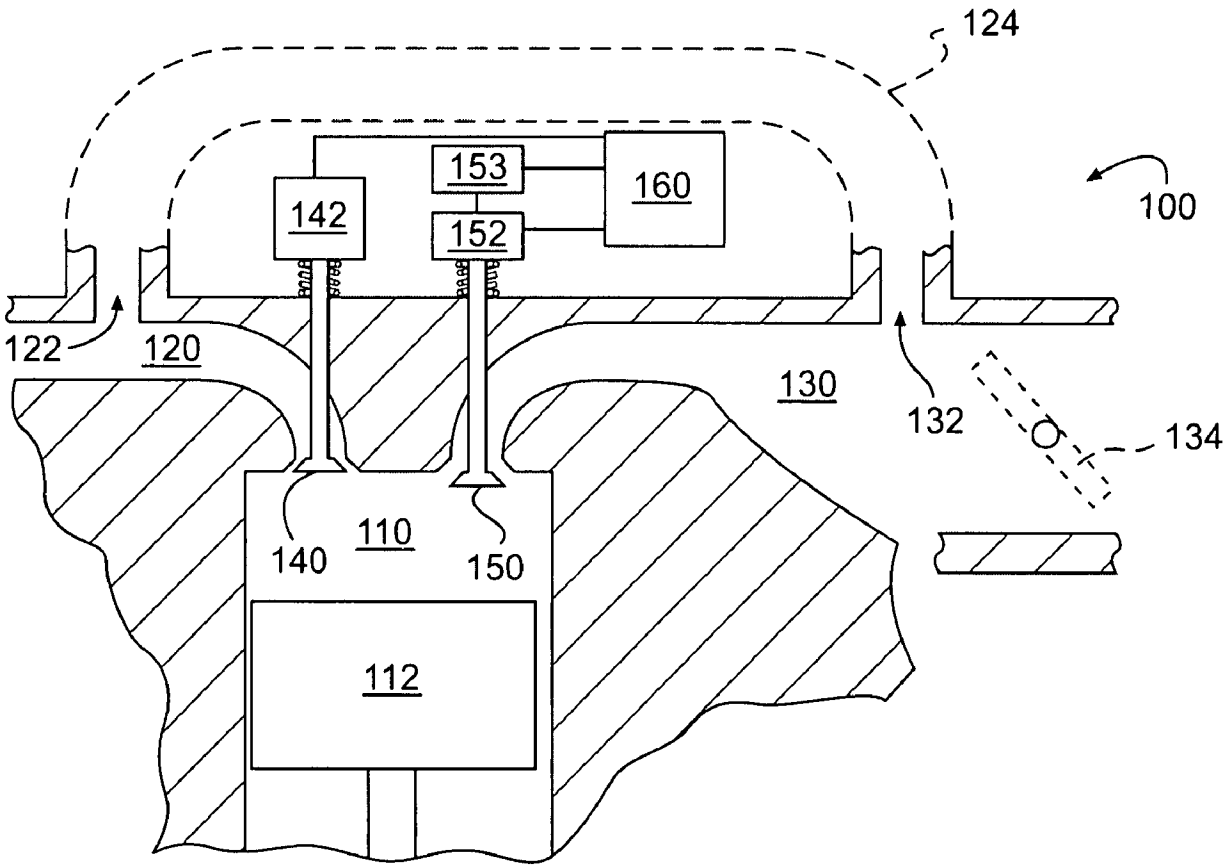
FIG. 3 is a schematic diagram of a second valve actuation system embodiment of the present invention.

With reference to FIG. 3, another system embodiment of the present invention is shown. An engine 100 may have one or more cylinders 110 in which a piston 112 may reciprocate upward and downward repeatedly during the times the engine is used for positive power and engine braking. At the top of the cylinder 110 there may be at least one intake valve 140 and at least one exhaust valve 150. The intake valve 140 and the exhaust valve 150 may be opened and closed to provide communication with an intake manifold 120 and an exhaust manifold 130, respectively.

The engine 100 may also include an intake valve actuating subsystem 142 for opening the intake valve during positive power and engine brake operation. An exhaust valve actuating subsystem 152 may be provided for opening and maintaining open the exhaust valve during positive power and engine brake operation. The exhaust valve actuating subsystem 152 may incorporate an engine braking device 153, or the later device may be provided separately. The intake valve actuating subsystem 142, the exhaust valve actuating subsystem 152, and/or the engine braking device 153 may constitute VVA systems.

The means for opening and maintaining open the intake and exhaust valves (142 and 152) may derive needed actuation forces from, or include, cams, push tubes, rocker arms, and/or other valve train elements in any combination. The means for opening and maintaining the engine valve(s) open may alternatively include a common rail hydraulic system or an electro-mechanical solenoid. Thus, the intake and exhaust valve actuating subsystems, and engine braking device, may comprise any hydraulic, electro-hydraulic, mechanical, electromechanical, electromagnetic, or other actuation devices. There are several known subsystems for opening intake and exhaust valves for intake, exhaust, and engine braking events, and it is contemplated that the invention could use any of such subsystems and/or new systems developed by the applicant or others.

Operation of the intake and exhaust valve actuating subsystems 142 and 152, and the engine braking device 153, may be controlled by controller 160. In one embodiment of the present invention, the controller 160 and the intake and exhaust valve actuating subsystems 142 and 152 may be provided collectively by a variable valve actuation (WA) system. The controller may be an electronic component, and may or may not be integrated into an ECM.

With continued reference to FIG. 3, in an alternative embodiment of the invention, the engine 100 may include an exhaust brake 134 installed in the exhaust pipe downstream of the exhaust manifold 130. The exhaust brake 134 is shown as a butterfly valve in FIG. 3, however, it is appreciated that it could be provided by any other type of selectively restrictive means.

In another alternative embodiment of the invention, the engine 100 may be provided with a means for providing external EGR. The external EGR means may include an exhaust manifold port 132 connected to an intake manifold port 122 by a recirculation passage 124. It is appreciated that the recirculation passage 124 need not necessarily connect the two manifolds directly to provide EGR. The recirculation passage 124 could connect with the intake side of the engine 100 at some place other than the intake manifold 120 and/or at some place other than the exhaust manifold 130.

Figure 4:
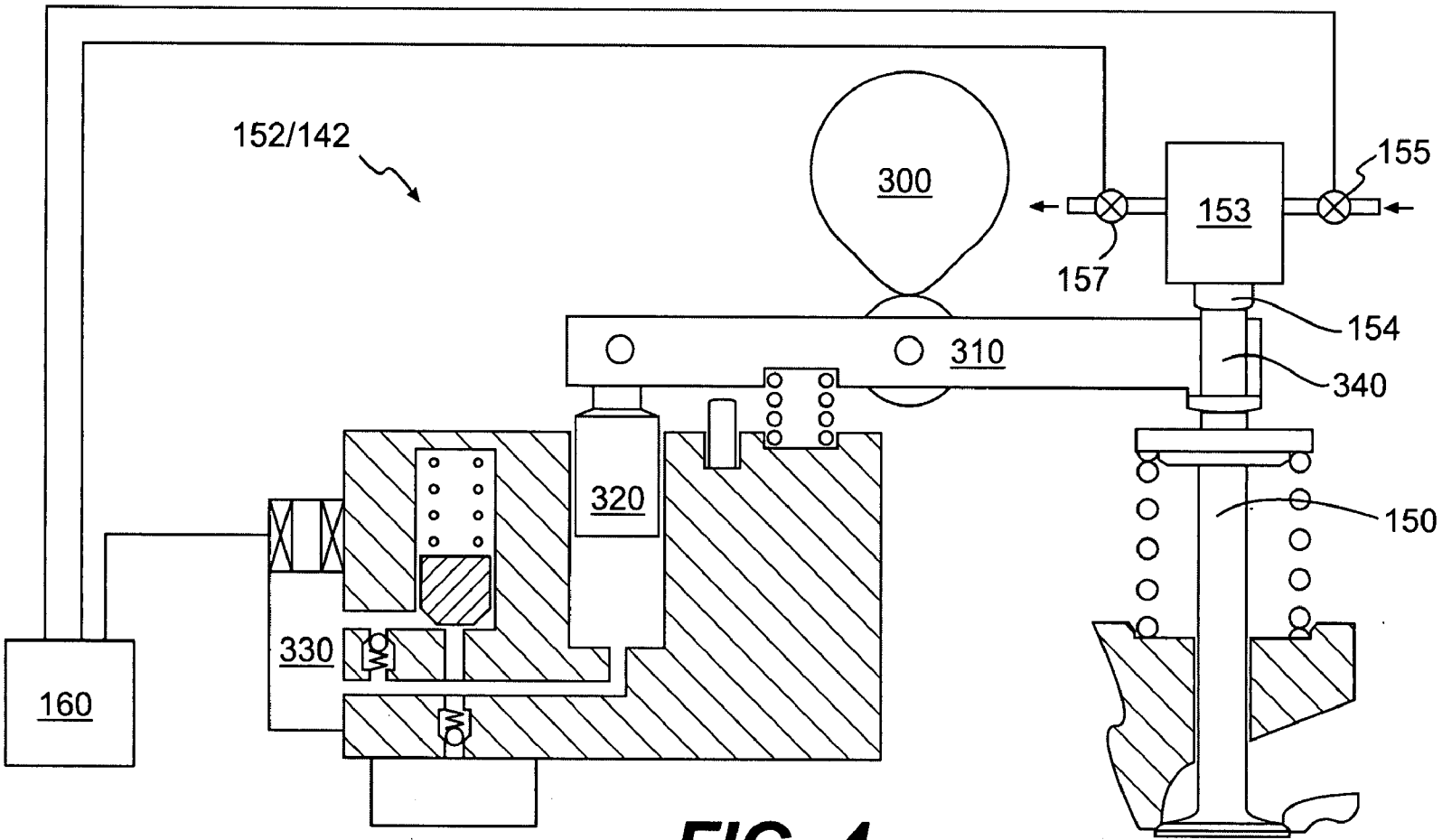
FIG. 4 is a schematic diagram of a third valve actuation system embodiment of the present invention.

With reference to FIG. 4, a detailed schematic diagram is provided of an alternative VVA and engine braking system that may be used to provide engine braking methods described below. The VVA system 152/142 is described in detail in Vorih et al., U.S. Pat. No. 6,510,824 (Jan. 28, 2003), entitled "Variable Lost Motion Valve Actuation and Method, which is hereby incorporated in full by reference. The VVA system 152/142 shown in FIG. 4 includes a cam 300 which may include multiple lobes adapted to provide main, EGR, engine braking, and/or other auxiliary valve events. The lobes of the cam 300 may selectively impart motion to the lever 310 as a function of the amount of hydraulic fluid supporting the piston 320 supporting one end of the lever. Selective supply and release of hydraulic fluid to and from the chamber under the piston 320 may be made by control of the trigger valve 330 using the controller 160. Control over the position of the piston 320 in turn enables control over the amount of valve actuation that is applied to the engine valve 150 in response to the rotation of the cam 300.

With continued reference to FIG. 4, an engine braking device 153 may also be provided to actuate the engine valve 150. The engine braking device 153 may include a hydraulic piston 154 that may be selectively extended downward into contact with a sliding pin 340 or directly with the engine valve 150. Extension and retraction of the hydraulic piston 154 may be controlled by a hydraulic fluid supply valve 155 and a hydraulic fluid release valve 157. The hydraulic piston 154 may be designed to have a limited amount of travel so that it can provide a pre-selected amount of valve lift for bleeder braking. The supply valve 155 and the release valve 157 may be operatively connected to the controller 160.

Figure 5:
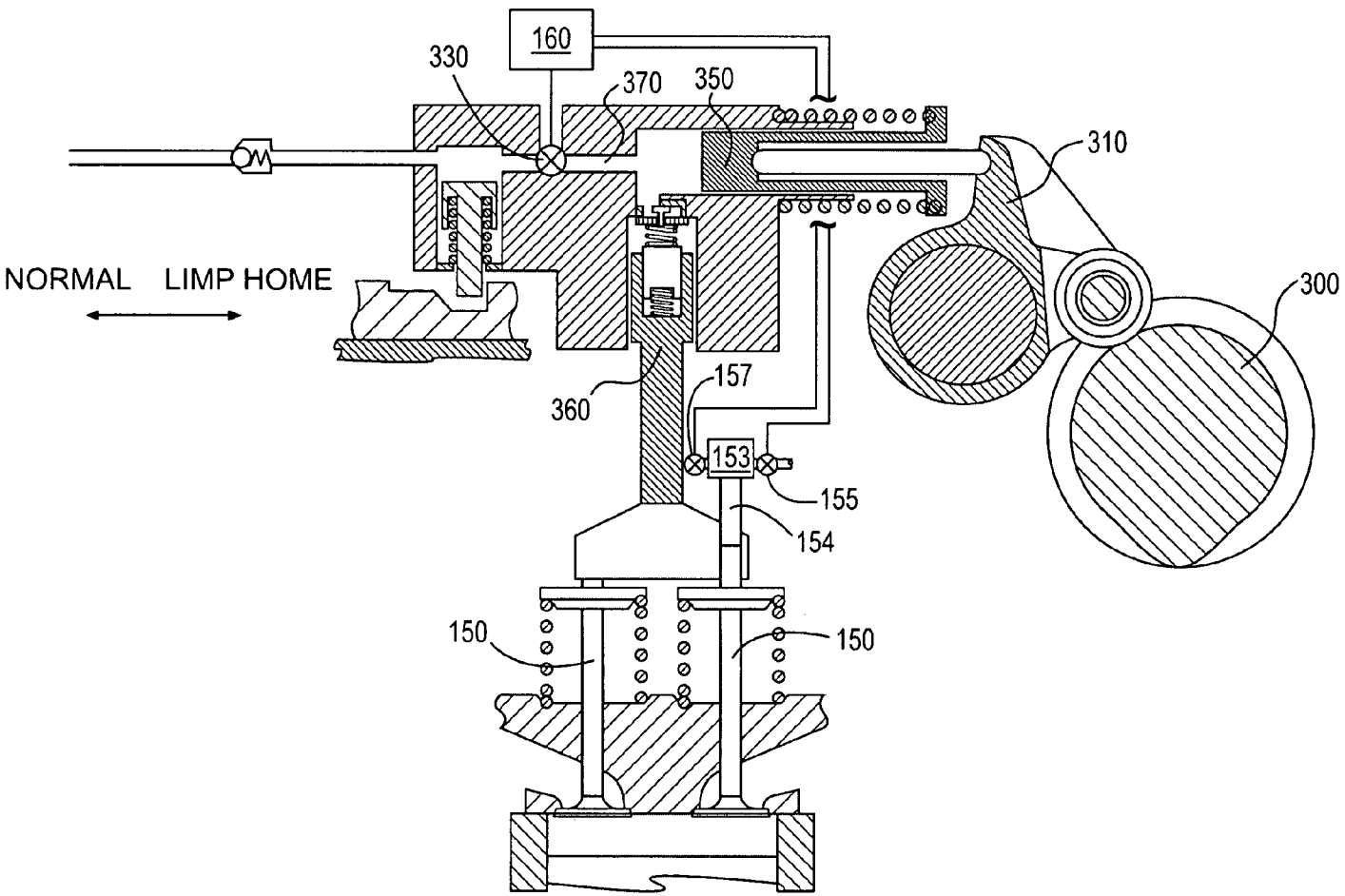
FIG. 5 is a schematic diagram of a fourth valve actuation system embodiment of the present invention.

With reference to FIG. 5, a detailed schematic diagram is provided of an alternative VVA and engine braking system that may be used to provide engine braking methods described below. The VVA system 152/142 is described in detail in Vanderpoel et al., U.S. Pat. Appl. Pub. No. US 2003/0221663 A1 (Dec. 4, 2003) entitled "Compact Lost Motion System for Variable Valve Actuation," which is hereby incorporated in full by reference. The VVA system 152/142 shown in FIG. 5 includes a cam 300 which may include multiple lobes adapted to provide main, EGR, engine braking, and/or other auxiliary valve events. The lobes of the cam 300 impart motion to the rocker 310, which in turn drives a master piston 350. The master piston 350 is selectively hydraulically linked to a slave piston 360 by a master-slave hydraulic circuit 370. Selective supply and release of hydraulic fluid to and from the master-slave hydraulic circuit 370 may be made by control of the trigger valve 330 under the influence of the controller 160. Control over the amount of fluid in the master-slave hydraulic circuit 370 in turn enables control over the amount of valve actuation that is applied to the engine valve 150 in response to the rotation of the cam 300.

With continued reference to FIG. 5, an engine braking device 153 may also be provided to actuate one or more of the engine valves 150. The engine braking device 153 may include a hydraulic piston 154 that may be selectively extended downward into contact with the engine valve 150 (or with an intervening sliding pin as shown in FIG. 4). Extension and retraction of the hydraulic piston 154 may be controlled by a hydraulic fluid supply valve 155 and a hydraulic fluid release valve 157. The supply valve 155 and the release valve 157 may be operatively connected to the controller 160.

Figure 6:
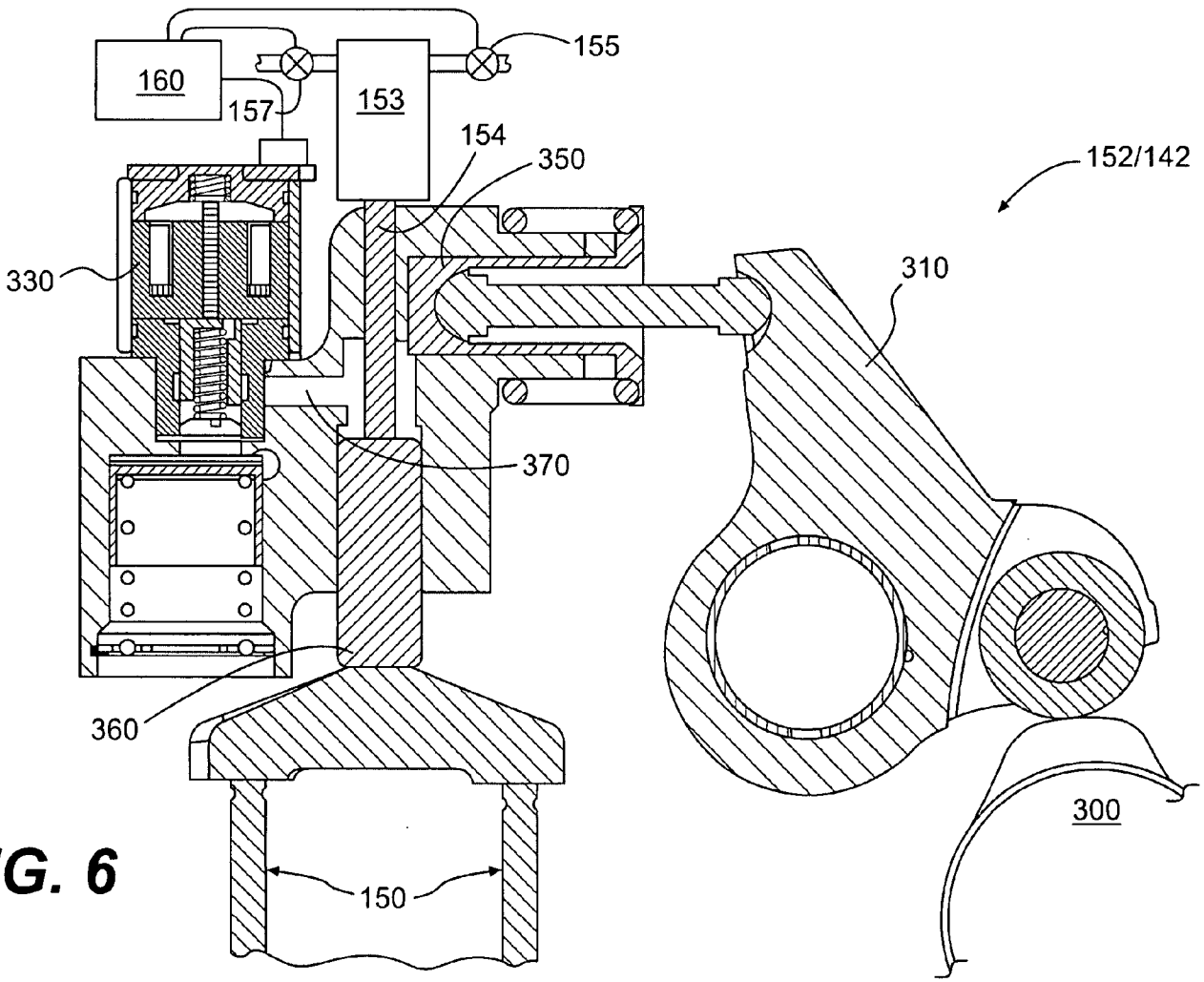
FIG. 6 is a schematic diagram of a fifth valve actuation system embodiment of the present invention.

A variation of the valve actuation system shown in FIG. 5 is shown in FIG. 6. In this variation the engine braking device 153 is provided above the slave piston 360. The engine braking device 153 may be operated in the same way it is operated in FIG. 5. Selective extension of the hydraulic piston 154 into the master-slave hydraulic circuit 370 enables the hydraulic piston 154 to lock the slave piston 360 into an open position, or alternatively, actuate it cyclically.

In the foregoing descriptions of FIGS. 4, 5 and 6, the engine braking device 153 is described as a hydraulic device. It is appreciated, however, that in alternative embodiments of the present invention the engine braking device need not be hydraulic. The piston 154 could be extended from the engine braking device 153 as a result of mechanical, electromechanical, electromagnetic, pneumatic, or some other type of actuation without departing from the intended scope of the present invention. Furthermore, it is appreciated that in hydraulic embodiments, extension and retraction of the hydraulic piston 154 may be controlled by a single hydraulic fluid supply and release valve, instead of by a separate supply valve 155 and a release valve 157.

To initiate bleeder-type engine braking using the arrangements shown in FIGS. 4, 5 and 6 hydraulic fluid may be released from under the piston 320 (FIG. 4) or from the master-slave hydraulic circuit 370 (FIGS. 5 and 6). Release of the hydraulic fluid from under the piston 320 (FIG. 4) or from the master-slave hydraulic circuit (FIGS. 5 and 6) may reduce, delay, or eliminate the affect of the cam 300 lobes on the engine valve depending on the amount of hydraulic fluid that is released. Preferably, the affect of the cam 300 on the engine valve is eliminated, thereby producing cylinder cut-out with respect to the VVA system 152/142. At this point, the supply valve 155 may be opened, and the release valve 157 may be maintained closed. Supply of hydraulic fluid to the engine braking device 153 may cause the hydraulic piston 154 to extend downward and open the engine valve 150 either directly (FIG. 5), through an intervening sliding pin 340 (FIG. 4), or through the slave piston 360 (FIG. 6). Once the engine valve 150 is in the desired position, the supply valve 155 may be closed, locking the hydraulic piston 154 into place to provide bleeder braking. Braking may be discontinued by opening the release valve 157.

The foregoing discussions of FIGS. 4, 5 and 6 have explained how the components shown therein may be used to provide bleeder braking. Compression-release engine braking may also be provided using the arrangements shown in FIGS. 4, 5 and 6. Compression-release braking may be initiated by placing the hydraulic piston 154 in hydraulic communication with a remote master piston (not shown) and opening the supply valve 155. In such instance the hydraulic piston 154 acts like a slave piston. In such a system the hydraulic piston 154 may mirror the movements of the remote master piston, which in turn may respond to the lobes of a cam. An example of a suitable master-slave piston arrangement is disclosed in Cummins, U.S. Pat. No. 3,220,392 (November 1965). It is appreciated that any known master-slave piston arrangement is suitable for use in implementing this embodiment of the present invention.

Figure 7:
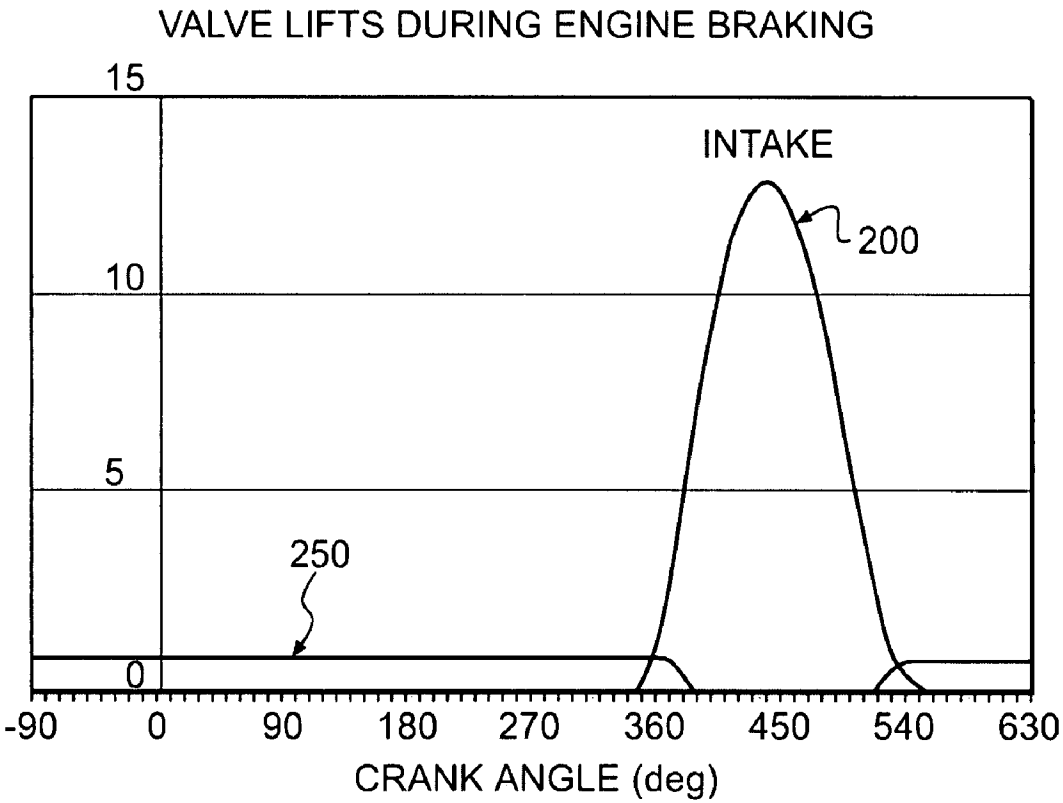
FIG. 7 is a graph of exhaust and intake valve lift for a full engine cycle provided in accordance with an engine braking method embodiment of the present invention.

Description of a first method embodiment of the present invention is now provided with reference to FIG. 7. The graph in FIG. 7 illustrates both the intake valve motion (profile 200) and the exhaust valve motion (profile 250) for an engine cycle of partial bleeder brake actuation. The relative amounts of exhaust valve lift and intake valve lift shown in the graph are not to scale, and are for illustrative purposes only. Crank angles 0–180 approximately correspond to the expansion stroke of the engine, crank angles 180–360 approximately correspond to the exhaust stroke, crank angles 360–540 approximately correspond to the intake stroke, and crank angles 540–0 approximately correspond to the compression stroke. The term "approximately" is used to indicate that the four strokes of an engine cycle are not necessarily confined to 180 degree increments. For example, it is appreciated that main intake and exhaust events may extend for more than 180 degrees, and that these events may overlap to some extent.

During a bleeder brake mode of engine operation, one or more of the intake and exhaust valves of at least one engine cylinder are actuated roughly in accordance with the profiles shown in FIG. 7. As shown, the intake valve actuation 200 remains unchanged from the intake valve actuation that occurs during positive power operation. In the example shown in FIG. 7, the intake valve actuation during positive power includes only a main intake valve event during the engine intake stroke. It is appreciated that the intake valve actuation during positive power operation could include other valve events, such as an EGR event, Miller cycle, etc., without departing from the intended scope of the invention.

With continued reference to FIG. 7, the exhaust valve motion 250 does represent a change from the exhaust valve motion that occurs during positive power operation. During the bleeder braking cycle shown, the exhaust valve is provided with a substantially constant amount of lift during the compression, expansion, and exhaust strokes of the engine. The exhaust valve is closed (i.e., reset) during all, or substantially all, of the intake stroke of the engine. Closing of the exhaust valve during the intake stroke may improve overall braking performance as compared with a similar system that does not close the exhaust valve during the intake stroke (as shown in FIG. 8).

Figure 8:
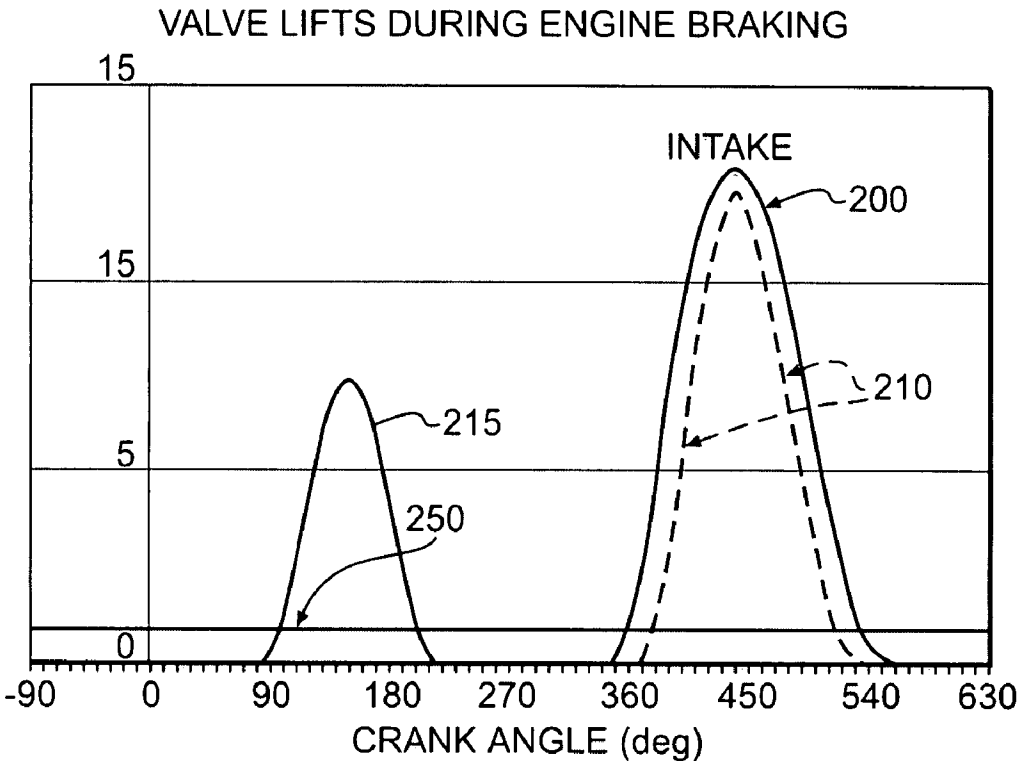
FIG. 8 is a graph of exhaust and intake valve lift for a full engine cycle provided in accordance with an alternative engine braking method embodiment of the present invention.

Description of a second method embodiment of the present invention is now provided with reference to FIG. 8. The graph in FIG. 8 illustrates a variation on the method illustrated in FIG. 7. Both the intake valve motion (profile 200) and the exhaust valve motion (profile 250) are shown for a full engine cycle of bleeder brake actuation. The relative amounts of exhaust valve lift and intake valve lift shown in the graph are not to scale, and are for illustrative purposes only. Crank angles shown in FIG. 8 correspond to the same engine strokes as shown in FIG. 7.

During the bleeder brake mode of engine operation in accordance with the second method embodiment of the present invention, one or more of the intake and exhaust valves of at least one engine cylinder are actuated in accordance with the profiles shown in FIG. 8. The intake valve actuation 200 remains unchanged from the intake valve actuation that occurs during positive power operation. The exhaust valve, however, is provided with a substantially constant amount of lift (profile 250) during the entire engine cycle, (i.e., the compression, expansion, exhaust and intake strokes of the engine). In this embodiment, the exhaust valve is not closed during the intake stroke of the engine.

In a variation of the second method embodiment of the present invention shown in FIG. 8 (which is also applicable to the method illustrated by FIG. 7), the intake valve may adhere to an alternative profile 210, and as a result open after and/or close before it does during positive power (i.e., delayed opening and advanced closing). Opening the intake valve later may reduce the likelihood that compressed high pressure gas blows into the intake manifold. The avoidance of this back flow may be desirable during some engine operating conditions. Preferably, the intake valve opening may be delayed or retarded a number of engine crank angle degrees, although it is appreciated that more or less delay falls within the intended scope of this embodiment of the present invention. The intake valve may also be closed earlier to produce a longer compression stroke or a higher cylinder compression pressure. Preferably, the intake valve closing may be advanced a number of engine crank angle degrees, although it is appreciated that more or less advancement falls within the intended scope of this embodiment of the present invention. Late opening and early closing of the intake valve may be accomplished using the VVA systems 152/142 shown in FIGS. 4, 5 and 6, as well as any other type of VVA system.

Figure 9:
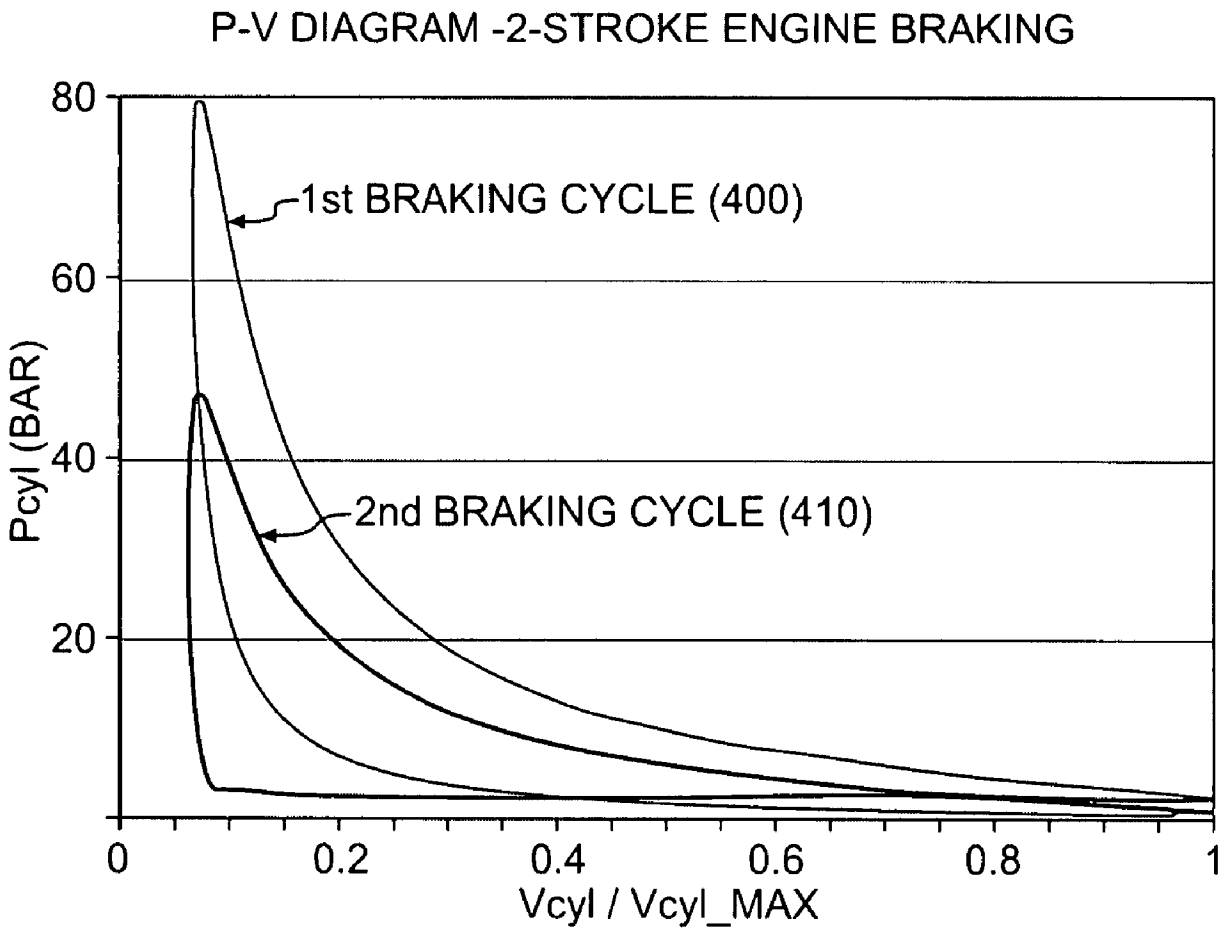
FIG. 9 is a P-V diagram illustrating the relative braking power of each of two braking strokes obtained using the exhaust valve lift profiles shown in FIGS. 7 and 8.

The P-V diagram in FIG. 9 provides an illustration of the relative amounts of braking power that may be obtained during each of the two engine braking cycles provided by the method embodiments of the present invention illustrated by FIGS. 7 and 8. The first braking cycle 400 may be larger than the second braking cycle because it is assumed that the cylinder is charged with gas from a main intake event for the first braking cycle, but is only charged with exhaust gas from bleeder-type engine braking for the second braking cycle. Preferably, the intake valve may open during the expansion stroke to provide full two-cycle bleeder braking, which may increase the braking power of the second braking cycle 410. An example of the valve actuation timing for the intake valve during the expansion stroke is provided as valve event 215 in FIG. 8.

Figure 10:
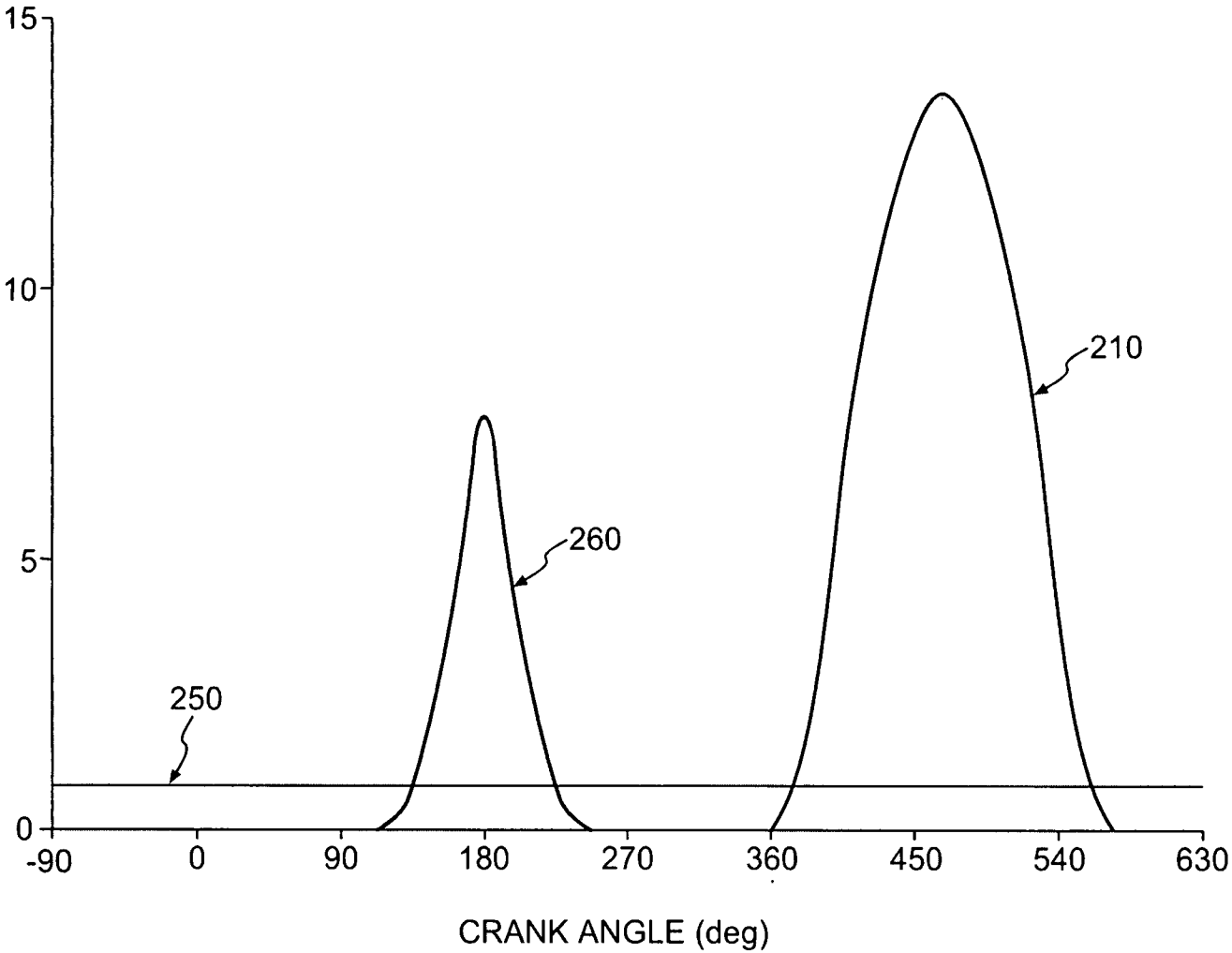
FIG. 10 is a graph of exhaust and intake valve lift for a full engine cycle provided in accordance with another alternative engine braking method embodiment of the present invention.

With reference to FIGS. 9 and 10, the second braking cycle 410 may be increased in size by charging the cylinder with additional gas. Preferably, additional exhaust gas may be introduced into the cylinder by using the VVA system to produce an additional exhaust valve event 260. In this embodiment of the invention, the exhaust valve is acted upon by the VVA system to produce the exhaust valve event 260 and by the engine braking device to produce the exhaust valve motion 250. The additional exhaust valve event 260 may be referred to as a brake gas recirculation (BGR) event, and may be produced using the main exhaust event lobe on the cam that drives the VVA system. For a BGR event, the main exhaust event may be modified to start after, and/or end before, it does during positive power (i.e., delayed opening and/or advanced closing). The precise exhaust valve closing point for event 260 may be determined by the competing pressures in the cylinder and the exhaust manifold.

Figure 11:
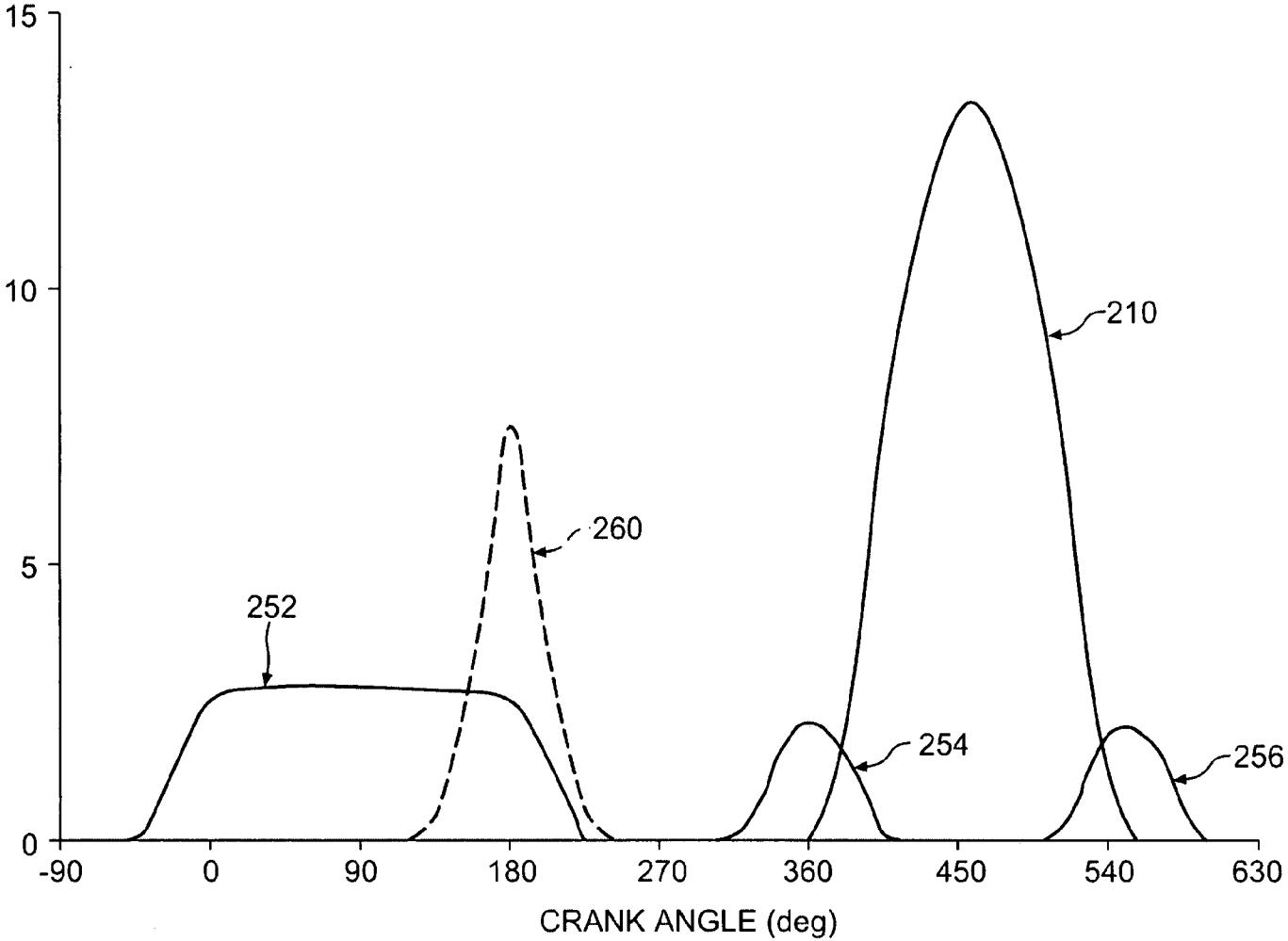
FIG. 11 is a graph of exhaust and intake valve lift for a full engine cycle provided in accordance with yet another alternative engine braking method embodiment of the present invention.

FIG. 11 shows a two-cycle compression-release variation of the bleeder braking illustrated in FIG. 10. With reference to both of these figures, the bleeder braking exhaust valve motion 250 in FIG. 10 is replaced with three individual exhaust valve events 252, 254, and 256. Each of these three events may be produced using either VVA systems, engine braking devices, or some combination of the two, which are discussed above. The first of the three exhaust valve events 252 provides a first compression-release event and a first BGR event. The second exhaust valve event 254 provides a second compression-release event. The third exhaust valve event 256 provides a second BGR event.

Figure 12:
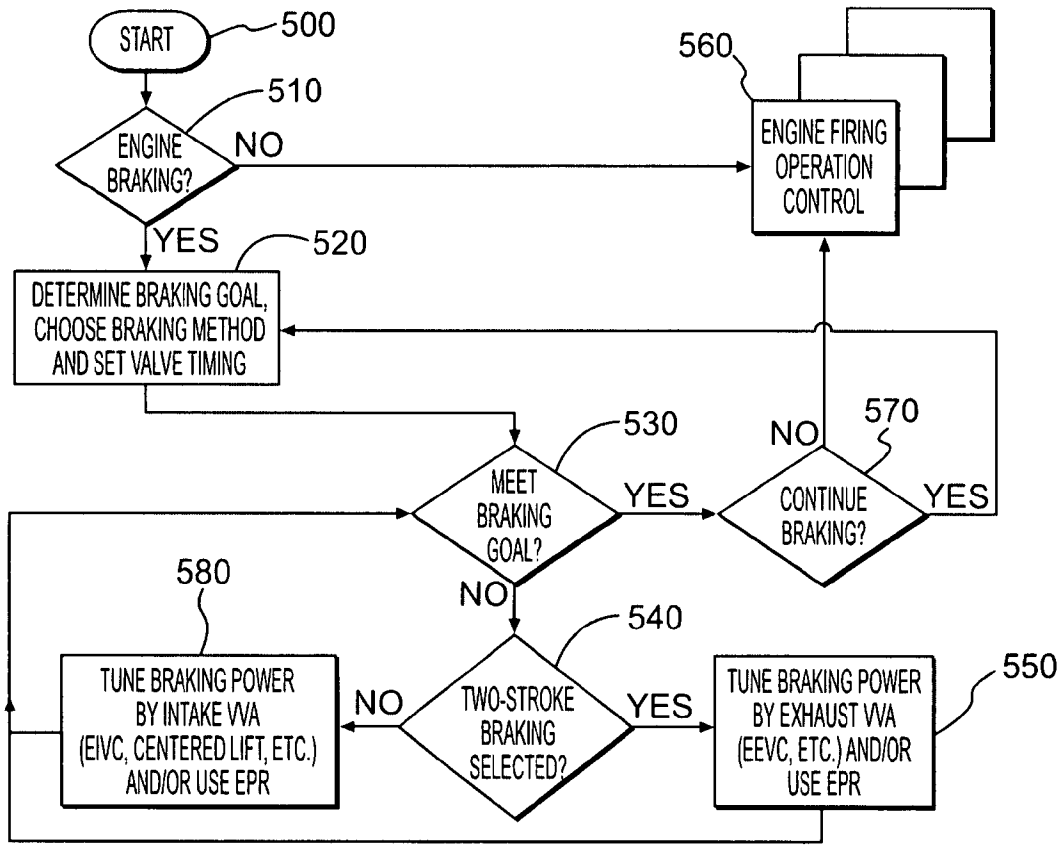
FIG. 12 is a control diagram for a method embodiment of the present invention for providing engine braking with VVA and VGT control.

FIG. 12 is a flow diagram of the control sequence for an engine braking method embodiment of the present invention that includes VVA and exhaust back pressure control. Most of the steps of the sequence illustrated are carried out by a VVA system, an ECM or similar controller, and one or more of a variable exhaust brake, a VGT, and EGR.

In step 500 engine braking may be requested by a driver or an automatic control component of the vehicle. In step 510, an appropriately program ECM or similar control device may determine whether or not engine braking may be started at the present time. If engine braking cannot be started, control is transferred to the engine firing operation control in step 560. If engine braking is possible, the braking goal (e.g., desired power), the braking method (e.g., full bleeder, partial bleeder, compression-release, two-cycle, four-cycle, less than all cylinders, exhaust back pressure control, etc.), and the required engine valve timing may be determined in step 520. At this point engine braking begins.

A determination is made in step 530 as to whether or not the braking goal determined in step 520 is being met. If the goal is being met, a determination as to whether or not continued braking is called for is made in step 570. If continued braking is called for, the control sequence returns to step 520. If continued braking is not called for, control is relinquished to the engine firing operation control in step 560.

If the braking goal is determined not to have been met in step 530, a determination as to whether or not a change in the braking method is warranted. For example, if the braking goal is determined not be have been met, the system may determine whether or not two-stroke (cycle) braking is being used in step 540. If two-stroke braking is being used, the system may adjust the actuation timing of the exhaust valve(s), adjust the exhaust back pressure in step 550, and/or other braking method parameters in a manner that is more likely to result in the braking goal being met. If two-stroke braking is not being used, the system may adjust the actuation timing of the intake valve(s), adjust the exhaust back pressure in step 580, and/or adjust some other braking method parameter in a manner that is likely to result in the braking goal being met. After steps 550 or 580, the sequence may return to step 530.

It will be apparent to those skilled in the art that variations and modifications of the present invention can be made without departing from the scope or spirit of the invention and the appended claims. For example, many of the foregoing embodiments of the invention have shown hardware adapted to open one of a pair of exhaust valves for the different engine braking events. It is understood that the described engine braking could be carried out with one or more of the exhaust valves associated with each engine cylinder without departing from the intended scope of the present invention. With respect to the various method embodiments of the present invention, it is understood that the practice of these methods with apparatus other than that disclosed in this application is intended to fall within the scope of the invention and the appended claims. It is also understood that each of the foregoing two-cycle engine braking embodiments may be modified to permanently or selectively provide four-cycle braking on a cylinder-by-cylinder basis if less braking power is needed.

What is claimed is:

1. A method of actuating intake and exhaust engine valves in an internal combustion engine cylinder to produce an engine braking effect, said method comprising the steps of:

opening at least one intake valve during an intake stroke of the engine cylinder; and providing a substantially constant lift to at least one exhaust valve during a plurality of successive intake, compression, expansion, and exhaust strokes of the engine cylinder.

2. The method of claim 1 further comprising the step of modifying the lift of at least one exhaust valve during successive exhaust strokes of the engine cylinder, wherein said modified lift is different than the lift attained by the same exhaust valve during positive power operation.

3. The method of claim 2 wherein the at least one exhaust valve provided with a substantially constant lift and the at least one exhaust valve provided with modified lift are the same exhaust valve.

4. The method of claim 2 wherein the at least one exhaust valve provided with a substantially constant lift and the at least one exhaust valve provided with modified lift are different exhaust valves associated with the engine cylinder.

5. The method of claim 2 wherein the step of opening at least one intake valve during the intake stroke is delayed relative to opening of the same intake valve for a main intake event during positive power operation.

6. The method of claim 2 further comprising the step of advancing a closing time of the at least one intake valve relative to the closing time of the same intake valve for a main intake event during positive power operation.

7. The method of claim 2 wherein the step of modifying the lift of the at least one exhaust valve comprises delaying the opening time of the at least one exhaust valve compared to the opening time of the same exhaust valve for a main exhaust event during positive power operation.

8. The method of claim 1 further comprising the step of opening the at least one exhaust valve for a brake gas recirculation event.

9. The method of claim 1 wherein the step of opening at least one intake valve during the intake stroke is delayed relative to opening of the same intake valve for the intake stroke during positive power operation.

10. The method of claim 9 further comprising the step of advancing a closing time of the at least one intake valve relative to the closing time of the same intake valve for the intake stroke during positive power operation.

11. The method of claim 1 further comprising the step of advancing a closing time of the at least one intake valve relative to the closing time of the same intake valve for the intake stroke during positive power operation.

12. The method of claim 1 further comprising the step of actuating an exhaust restriction device to regulate exhaust back pressure applied to the engine cylinder.

13. A method of actuating at least one exhaust valve in an internal combustion engine cylinder to produce an engine braking effect, said method comprising the step of:

maintaining the at least one exhaust valve open with a substantially constant lift during intake, compression, expansion, and exhaust strokes of the engine cylinder.

14. A method of actuating engine valves including at least one exhaust valve in an internal combustion engine cylinder to produce an engine braking effect, said method comprising the steps of:

maintaining the at least one exhaust valve open with a substantially constant lift during compression, expansion, and exhaust strokes of the engine cylinder; and maintaining the at least one exhaust valve closed during at least a portion of an intake stroke of the engine cylinder.

15. The method of claim 14 further comprising the step of modifying the lift of the at least one exhaust valve during successive exhaust strokes of the engine cylinder, wherein said modified lift is different than the lift attained by the same exhaust valve during positive power operation.

16. The method of claim 15 further comprising the step of delaying an opening time of at least one intake valve in the engine cylinder relative to the opening time of the same intake valve for a main intake event during positive power operation.

17. The method of claim 15 further comprising the step of advancing a closing time of at least one intake valve in the engine cylinder relative to the closing time of the same intake valve for a main intake event during positive power operation.

18. The method of claim 15 wherein the step of modifying the lift of the at least one exhaust valve comprises delaying the opening time of the at least one exhaust valve compared to the opening time of the same exhaust valve for a main exhaust event during positive power operation.

19. The method of claim 14 further comprising the step of opening the at least one exhaust valve for a brake gas recirculation event.

20. The method of claim 14 further comprising the step of delaying an opening time of at least one intake valve in the engine cylinder relative to the opening time of the same intake valve for a main intake event during positive power operation.

21. The method of claim 20 further comprising the step of advancing a closing time of the at least one intake valve relative to the closing time of the same intake valve for the main intake event during positive power operation.

22. The method of claim 14 further comprising the step of advancing a closing time of at least one intake valve in the engine cylinder relative to the closing time of the same intake valve for a main intake event during positive power operation.

23. A method of actuating intake and exhaust valves in an internal combustion engine cylinder to produce an engine braking effect, said method comprising the steps of:

actuating at least one intake valve during an intake stroke of the engine cylinder using a variable valve actuation system; and actuating at least one exhaust valve during at least portions of compression, expansion, and exhaust stokes of the engine cylinder using an engine braking device.

24. The method of claim 23 further comprising the step of actuating the at least one exhaust valve during at least a portion of the intake stroke of the engine cylinder using the engine braking device.

25. The method of claim 23 wherein actuation of the at least one exhaust valve provides bleeder braking.

26. The method of claim 23 wherein actuation of the at least one exhaust valve provides compression-release braking.

27. The method of claim 23 further comprising the steps of:

determining the magnitude of engine braking that is desired; and attempting to provide the determined magnitude of engine braking by selectively varying the number of engine cylinders used for engine braking.

28. The method of claim 23 further comprising the steps of:

determining the magnitude of engine braking that is desired; and attempting to provide the determined magnitude of engine braking by selectively adjusting the actuation of the at least one exhaust valve.

29. The method of claim 23 further comprising the steps of:

determining the magnitude of engine braking that is desired; and attempting to provide the determined magnitude of engine braking by selectively adjusting the actuation of the at least one intake valve.

30. The method of claim 23 further comprising the steps of:

determining the magnitude of engine braking that is desired; and attempting to provide the determined magnitude of engine braking by selectively adjusting the setting of a variable geometry turbocharger associated with the engine.

31. The method of claim 23 further comprising the step of providing at least one exhaust valve with modified lift during successive exhaust strokes of the engine cylinder, wherein said modified lift is different than the lift attained by the same exhaust valve during positive power operation.

32. The method of claim 23 wherein the step of actuating at least one intake valve during the intake stroke is delayed relative to actuation of the same intake valve for the intake stroke during positive power operation.

33. The method of claim 23 further comprising the step of advancing a closing time of the at least one intake valve relative to the closing time of the same intake valve for the intake stroke during positive power operation.

34. The method of claim 23 further comprising the step of actuating an exhaust restriction device to regulate exhaust back pressure applied to the engine cylinder.

35. An apparatus for actuating at least one exhaust valve in an internal combustion engine cylinder to produce a main exhaust event during positive power operation and an engine braking effect during engine braking operation, said apparatus comprising:

means for opening the at least one exhaust valve for the main exhaust event during an engine exhaust stroke; and means for maintaining the at least one exhaust valve open with a substantially constant lift during engine intake, compression, expansion, and exhaust strokes.

36. An apparatus for actuating at least one exhaust valve in an internal combustion engine cylinder to produce a main exhaust event during positive power operation and an engine braking effect during engine braking operation, said apparatus comprising:

means for opening the at least one exhaust valve for the main exhaust event during an engine exhaust stroke; and means for maintaining the at least one exhaust valve open with a substantially constant lift during substantially all of engine compression, expansion, and exhaust strokes.

37. A method of actuating intake and exhaust valves in an internal combustion engine cylinder to produce an engine braking effect, said method comprising the steps of:

determining an engine braking power goal;

implementing an engine braking method based at least in part on the engine braking power goal, said engine braking method being selected from the group consisting of one or more of: full bleeder braking, partial bleeder braking, compression-release braking, two-cycle braking, four-cycle braking, and exhaust back pressure regulation;

actuating one or more engine valves based at least in part on the engine braking method; and determining whether the engine braking goal is being met.

38. The method of claim 37 further comprising the steps of:

determining whether to implement two-stroke engine braking based at least in part on the determination of whether the engine braking goal is being met; and adjusting the actuation of one or more exhaust valves based at least in part on the determination of whether to implement two-stroke engine braking.

39. The method of claim 38 further comprising the step of:

adjusting the actuation of one or more intake valves based at least in part on the determination of whether to implement two-stroke engine braking.

40. The method of claim 39 further comprising the step of:

adjusting exhaust back pressure based at least in part on the determination of whether the engine braking goal is being met.

41. The method of claim 37 further comprising the steps of:

determining whether to implement two-stroke engine braking based at least in part on the determination of whether the engine braking goal is being met; and adjusting of the actuation of one or more intake valves based at least in part on the determination of whether to implement two-stroke engine braking.

42. The method of claim 37 further comprising the steps of:

adjusting exhaust back pressure based at least in part on the determination of whether the engine braking goal is being met.

43. The method of claim 23 wherein the step of actuating the at least one exhaust valve comprises providing at least one brake gas recirculation event and at least one compression-release engine braking event per engine cycle.

44. The method of claim 23 wherein the step of actuating the at least one exhaust valve comprises providing at least two brake gas recirculation events and at least two compression-release engine braking events per engine cycle.

45. The method of claim 2 wherein the step of modifying the lift of the at least one exhaust valve comprises advancing the closing time of the at least one exhaust valve compared to the closing time of the same exhaust valve for a main exhaust event during positive power operation.

46. The method of claim 15 wherein the step of modifying the lift of the at least one exhaust valve comprises advancing the closing time of the at least one exhaust valve compared to the closing time of the same exhaust valve for a main exhaust event during positive power operation.

47. The method of claim 23 further comprising the steps of:

determining the magnitude of engine braking that is desired; and selectively modifying the braking method in an attempt to provide the determined magnitude of engine braking.

* * * * *